United States Patent [19]

Bauer

[11] Patent Number: 4,804,126

[45] Date of Patent: Feb. 14, 1989

[54] YARN CONVEYING APPARATUS

[75] Inventor: Karl Bauer, Remscheid, Fed. Rep. of Germany

[73] Assignee: Barmag AG, Remscheid, Fed. Rep. of Germany

[21] Appl. No.: 941,051

[22] Filed: Dec. 12, 1986

[30] Foreign Application Priority Data

Dec. 14, 1985 [DE] Fed. Rep. of Germany ..... 3544336
Feb. 6, 1986 [DE] Fed. Rep. of Germany ..... 3603588

[51] Int. Cl.[4] ..... B65H 51/00; B66D 1/30

[52] U.S. Cl. ..... 226/182; 226/173; 226/186; 254/371

[58] Field of Search ..... 226/168, 181, 182, 185, 226/186, 190, 173; 242/47.12; 254/371; 57/338

[56] References Cited

U.S. PATENT DOCUMENTS 3,332,597 7/1967 Missioux ..... 226/190
3,382,398 5/1968 Austin et al. ..... 226/182 X
3,907,189 9/1975 Griffith ..... 226/182 X
4,015,447 4/1977 Philip ..... 226/182 X
4,424,664 1/1984 Bauer et al. ..... 57/338

FOREIGN PATENT DOCUMENTS 3028316 2/1981 Fed. Rep. of Germany .
536872 12/1976 U.S.S.R. ..... 226/182

*Primary Examiner*—Stuart S. Levy
*Assistant Examiner*—Lynn M. Sohacki
*Attorney, Agent, or Firm*—Bell, Seltzer, Park & Gibson

[57] ABSTRACT

A yarn conveying apparatus is disclosed, and which comprises a pair of circular discs, each having a yarn engaging front surface. The discs are mounted for rotation about respective axes which are inclined with respect to each other, and such that portions of the respective yarn engaging front surfaces are disposed in a closely adjacent opposing face-to-face relationship and define a yarn advancing zone therebetween. The discs are resiliently biased toward each other at the yarn advancing zone, and so that the discs are adapted to engage and advance a yarn which is guided through the advancing zone, without substantial slippage.

15 Claims, 4 Drawing Sheets

YARN CONVEYING APPARATUS

BACKGROUND OF THE PRESENT INVENTION

The present invention relates to an apparatus for the slip-free conveyance of a yarn, and which includes two discs which are movable axially with respect to each other.

Yarn conveying devices are known from the prior art which include two discs which move axially with respect to one another, note for example DE-OS No. 30 28 316. However, prior devices of this type are not suitable for slip-free conveyance. Rather, these are designed according to their function so as to allow limited slippage because they are used as so-called overfeed rollers.

Belt delivery mechanisms, and feed cylinders with pressure or godet rolls and guide rolls, are presently utilized for slip-free conveyance of yarn. However, these prior devices have disadvantages. For example, although belt delivery systems are simple to operate, the bearings are highly stressed owing to the necessary belt tension and in addition, the belts are susceptible to wear and their useful life often amounts to only a few weeks or months. In the case of feed cylinders, the pressure rolls which press the yarn onto the feed cylinders are also very susceptible to wear and frequently have to be re-ground. Substantial energy losses also occur, owing to bearing friction and the flexing work of the rubber coating of the pressure rolls. Further, the feed cylinders and guide rolls are expensive to produce, and they operate reliably only when the arriving and issuing yarn is subjected to a minimum yarn tension. Otherwise slippage can easily occur.

It is accordingly an object of the present invention to provide a yarn conveying apparatus which provides for the slip-free advance of a yarn, and which overcomes the above noted limitations and disadvantages of the present systems.

It is also an object of the present invention to provide a yarn conveying apparatus which is simple in design, and which operates reliably and without substantial wear.

SUMMARY OF THE INVENTION

These and other objects and advantages of the present invention are achieved in the embodiments illustrated herewith by the provision of a yarn conveying apparatus which comprises a pair of yarn conveying discs, with each disc including a yarn engaging front surface. Means are provided for mounting the discs for rotation about respective axes and in respective rotational directions, such that portions of the respective yarn engaging front surfaces are disposed in a closely adjacent opposing face-to-face relationship and define a yarn advancing zone therebetween, and such that the respective yarn engaging front surfaces run in substantially the same direction through the yarn advancing zone. Means are also provided for resiliently biasing the discs toward each other at the yarn advancing zone, and so that upon rotation of the discs, the discs are adapted to engage and advance a yarn which is guided through the advancing zone, without slippage.

The axes of rotation of the two discs are preferably non-parallel, and intersect each other at a location which is substantially between the rotational centerpoints of the two discs. Preferably, the axes of rotation intersect at an angle of between about 2° to 15°, and most preferably, they intersect at an angle of between about 3° and 10°.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF PREFERRED EMBODIMENTS

Figure 1:
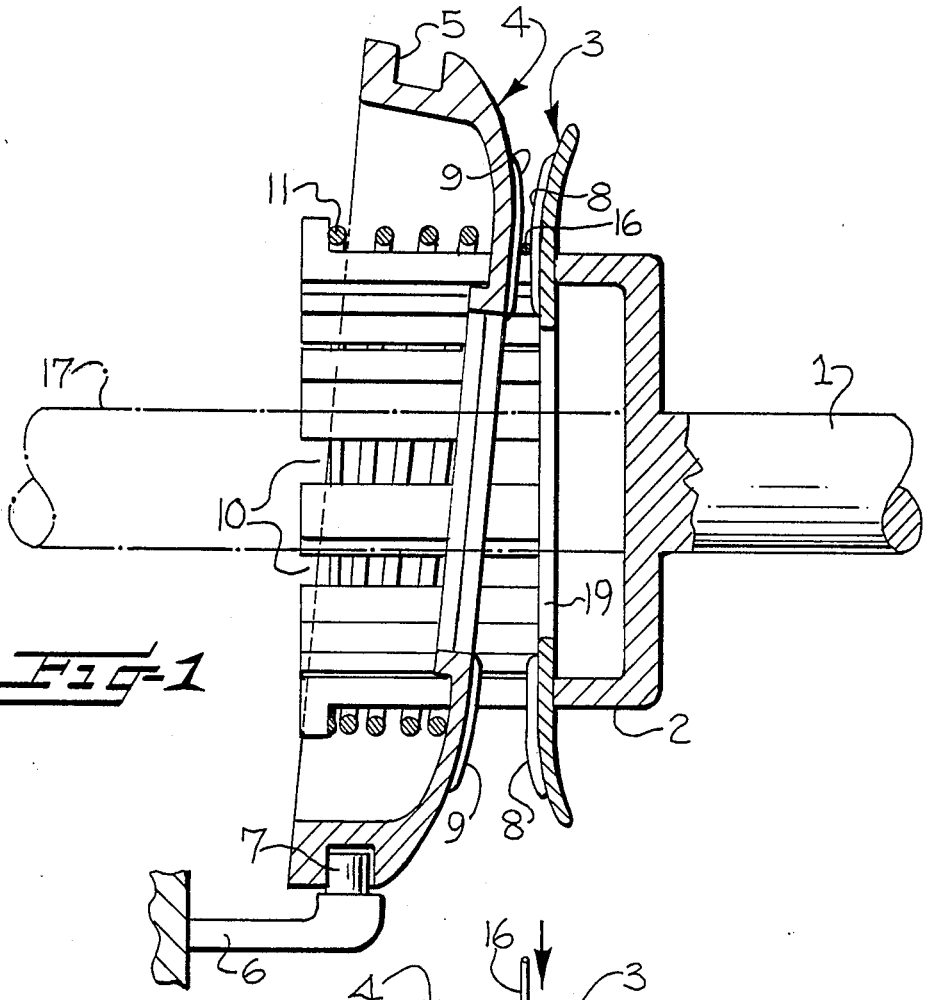
FIG. 1 is a sectional side elevation view of a yarn conveying apparatus which embodies the present invention.

Referring more particularly to the drawings, FIG. 1 illustrates a preferred embodiment of the present invention, and which includes a pair of yarn conveying circular discs 3 and 4. The first disc 3 includes a central opening 19, and a plurality of radial slots which extend outwardly from the central opening 19 and which are regularly spaced about the periphery of the opening 19 to define a plurality of radial fingers which are disposed between the slots. The outer periphery of the disc 3 is circumferentially continuous, and the left surface of the disc 3 as seen in FIG. 1 constitutes a yarn engaging front surface. The yarn engaging front surface includes circumferentially spaced apart raised portions or knobs 8 on the fingers for engaging a yarn 16 in the manner further described below.

The first disc 3 is rotatably mounted by an arrangement which includes a drive shaft 1 having an annular hub 2 fixed at one end thereof. The forward or left end of the hub as seen in FIG. 1 includes a plurality of axial slots 10 which are regularly spaced about the periphery thereof, and the slots of the hub 2 are sized to receive the fingers of the disc 3 so that the disc 3 may be assembled by initially sliding the disc 3 onto the hub 2 from its open forward end. The disc 3 is then fixedly mounted to the hub with the fingers extending through respective ones of the slots in the hub 2, and in the position shown in FIG. 1. Thus the disc 3 is rotatable with the shaft 1 about the axis of the shaft.

The second disc 4 is somewhat dish shaped, and it includes a yarn engaging front surface on its right side as seen in FIG. 1. The disc 4 includes a central opening, and a plurality of slots which extend outwardly from the central opening and which define radially extending fingers. The fingers are regularly spaced about the periphery thereof and are received in the slots of the hub 2. The outermost periphery of the disc 4 is continuous, and it includes an outwardly facing peripheral channel 5. Also, raised knobs 9 are mounted on the fingers of the disc 4 for engaging the yarn 16.

A coil spring 11 is disposed between the shoulder at the forward end of the hub and the disc 4, for biasing the disc 4 toward the disc 3. Also, a guide 7 which is mounted at the end of a fixed arm 6, is positioned to enter the channel 5, and so as to maintain the disc 4 at an inclination with respect to the disc 3. More particularly, the guide 7 supports the disc 4 so that it rotates about a second axis which is non-parallel to and which intersects the axis of the shaft 1. The intersection of the axes is inside the hub 2, and also it will be seen that the intersection is at a location which is substantially between the two centerpoints of the two discs. Preferably, the axes of rotation intersect at an angle of between about 2° to 15°, and most preferably, the angle is between about 3° and 10°. Thus as illustrated in FIG. 1, the upper portions of the respective yarn engaging front surfaces of the two discs 3 and 4 are disposed in a closely adjacent opposing face-to-face relationship and define a yarn advancing zone therebetween, and the yarn engaging front surfaces of the two discs run in substantially the same direction through the yarn advancing zone, upon rotation of the drive shaft. Thus the discs 3 and 4 are adapted to engage and advance a yarn 16 which is guided through the advancing zone, without substantial slippage. Also, the portion of the hub 2 between the discs 3, 4 will be seen to comprise a concentric yarn guide surface for supporting the yarn 16 in a radially inward direction as it advances through the yarn advancing zone.

FIG. 1 illustrates the guide 7 as a cylindrical post. Alternatively, the guide 7 may be composed of a small ball bearing which is supported on a thin pin, and such that the ball bearing is set into rotation by the internal wall of the groove 5, to thereby reduce the friction between the guide 7 and the groove 5 of the disc. As a further alternative construction, a continuous drive shaft as indicated in dashed lines at 17 may be employed which continues forwardly through the hub 2 and the two discs.

The discs 3 and 4 are preferably fabricated from a suitable metal, and the yarn engaging surfaces may include a coating of a ceramic material, or a resilient abrasion resistant material such as rubber or polyurethane.

Figure 2:
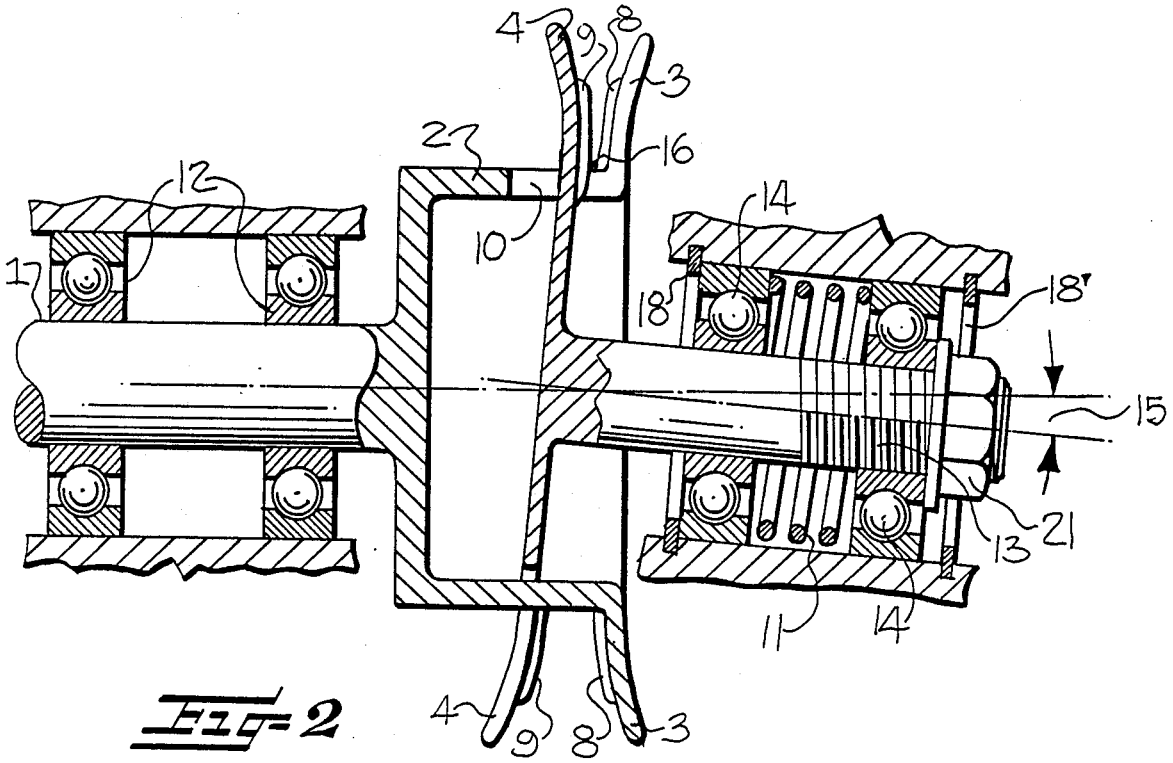
FIG. 2 is a sectional side elevation view of another embodiment of the present invention.

FIG. 2 illustrates a further preferred embodiment of the present invention. In this embodiment, the rotating hub 2 is mounted on the end of the drive shaft 1, which in turn is rotatably mounted by the two ball bearings 12. The first disc 3 is formed directly at the forward open end of the hub, and the second disc 4 includes a mounting shaft 13 and is supported at the forward end of the hub 2 adjacent the disc 3. More particularly, the rotating hub 2 includes slots 10 which communicate with the forward open end, so that the second disc 4, which is also suitably slotted, may be assembled onto the hub 2 in the manner illustrated in FIG. 2. The mounting shaft 13 of the second disc 4 is supported by two ball bearings 14, and as illustrated, the axes of the drive shaft 1 and the mounting shaft 13 are angled with respect to each by the angle 15. The intersection is at a location within the interior of the hub 2. The angled orientation of the discs results in the yarn 16 being engaged over only a portion of the adjacent yarn engaging surfaces and here again, the angle between the axes of the shafts 1 and 13 should be between about 2° and 15°, and most preferably between about 3° and 10°.

Figure 3A:
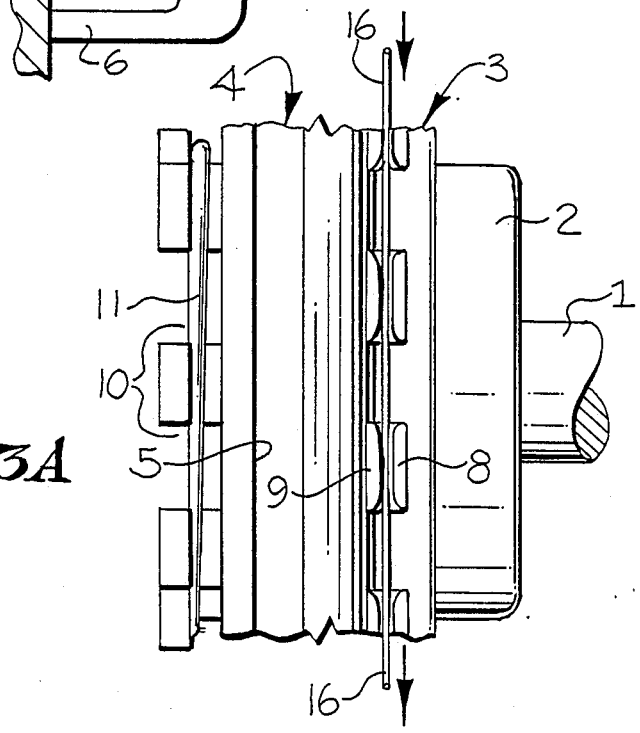
FIG. 3A is a fragmentary top plan view of the embodiment shown in FIG. 1.

The yarn engaging surfaces of the two discs 3 and 4 and which come into direct contact with the yarn, may be of differing designs. For example, these surfaces may include the knobs 8 and 9 which are directly aligned with each other as in FIG. 3A, to thereby clamp the yarn 16 without deflecting the yarn in a direction transverse to its direction of travel. Alternatively, the knobs 8 and 9 may be arranged in such a way that the knobs 8 of the disc 3 are received in the spaces between the knobs 9 of the disc 4, and thus the advancing yarn 16 is clamped and deflected between the knobs at the points indicated by the circles 20 as seen in FIGS. 3B and 4.

In the embodiment of FIG. 2, the inclined disc 4 is biased against the first disc 3 by means of a compression spring 11 which is mounted between the two ball bearings 14. For this purpose, one ball bearing is secured in the mounting structure by a snap ring 18 at the end adjacent the discs. The opposite ball bearing is supported by the nut 21 secured on the end of the shaft 13, and a second snap ring 18′ on the other side of the bearings serves to limit the maximum axial movement of the shaft 13 and disc 4.

Figure 3B:
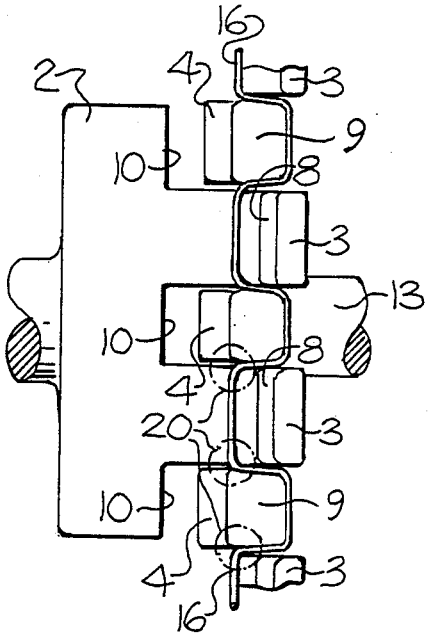
FIG. 3B is a fragmentary top plan view of the embodiment shown in FIG. 2.
Figure 4:
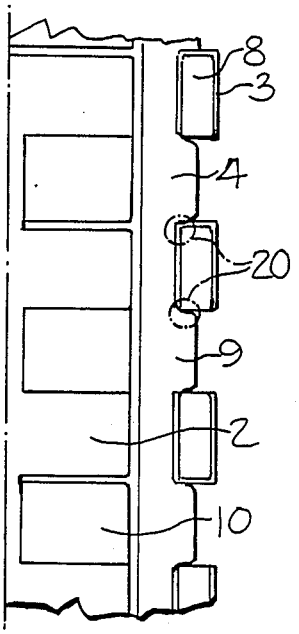
FIG. 4 is a view similar to FIG. 3B, but illustrating a modified embodiment.

FIG. 4 illustrates an embodiment which is similar to FIG. 3B, but wherein the knobs 8 and 9 are modified. In order to obtain a good frictional engagement between the yarn 16 and the knobs 8 and 9, the knobs are designed in FIG. 3B in such a way that a marked yarn deflection occurs between the adjacent knobs. However, under some circumstances this can lead to the drawing of the conveyed yarn 16, and if this drawing is to be avoided, then the knobs 8 and 9 may be designed in the manner shown in FIG. 4. Specifically, the clamping points as seen at 20 in FIG. 4 are also provided, but the respective deflection of the advancing yarn is minimal so that the risk of drawing is substantially alleviated.

Figure 5A:
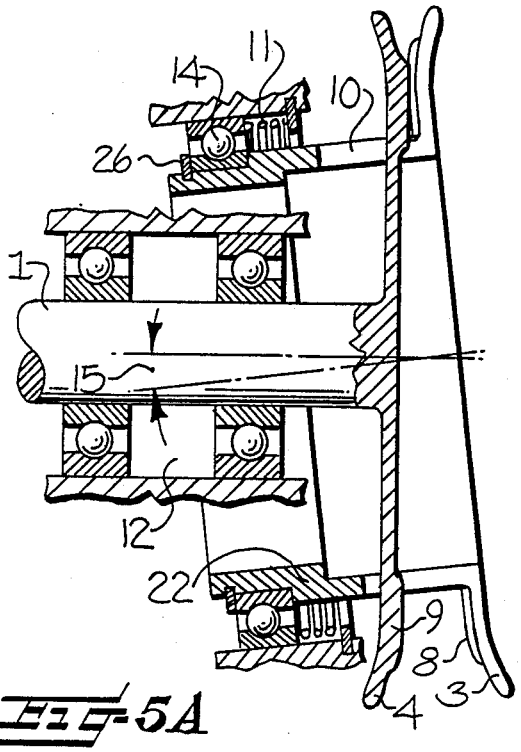
FIG. 5A is a sectional side elevation view of still another embodiment of the present invention.
Figure 5B:
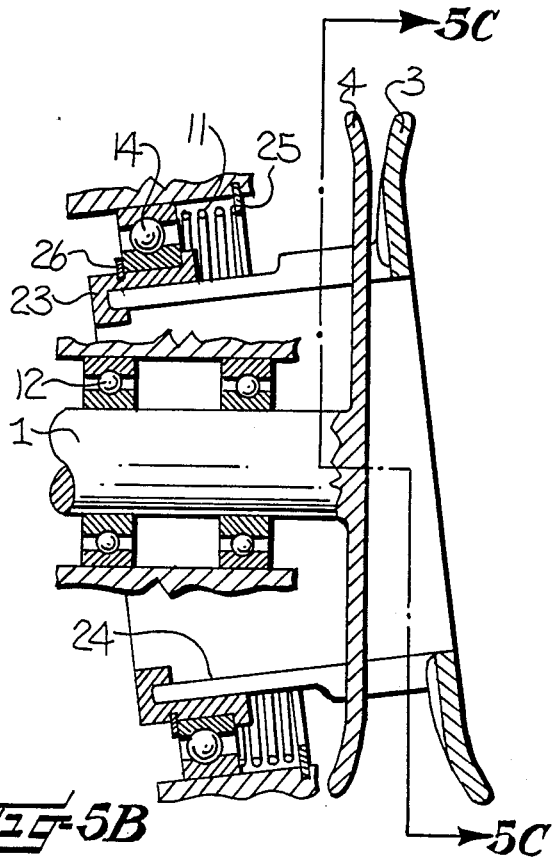
FIG. 5B is a sectional side elevation view of a further embodiment of the present invention.
Figure 5C:
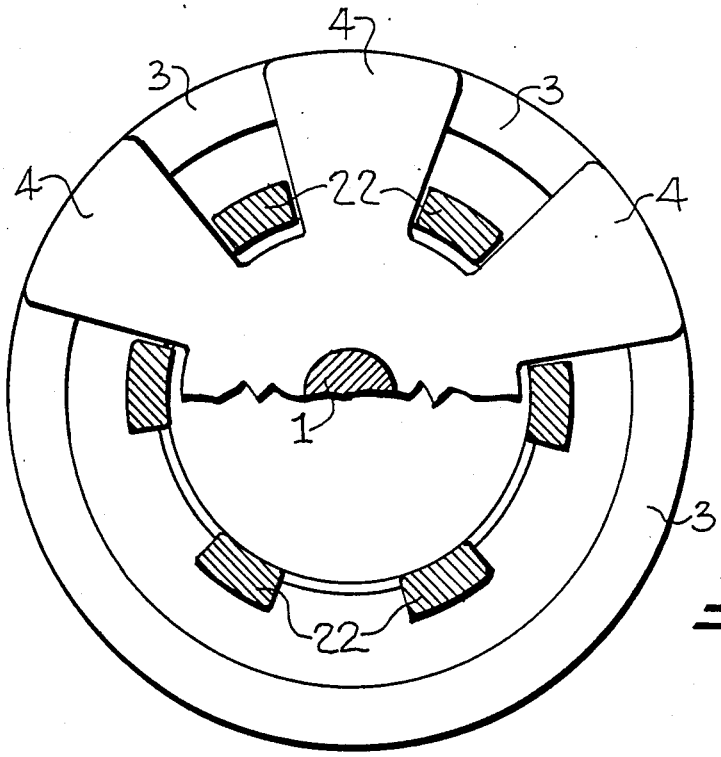
FIG. 5C is a sectional view taken substantially along the line 5C—5C of FIG. 5B.
Figure 6:
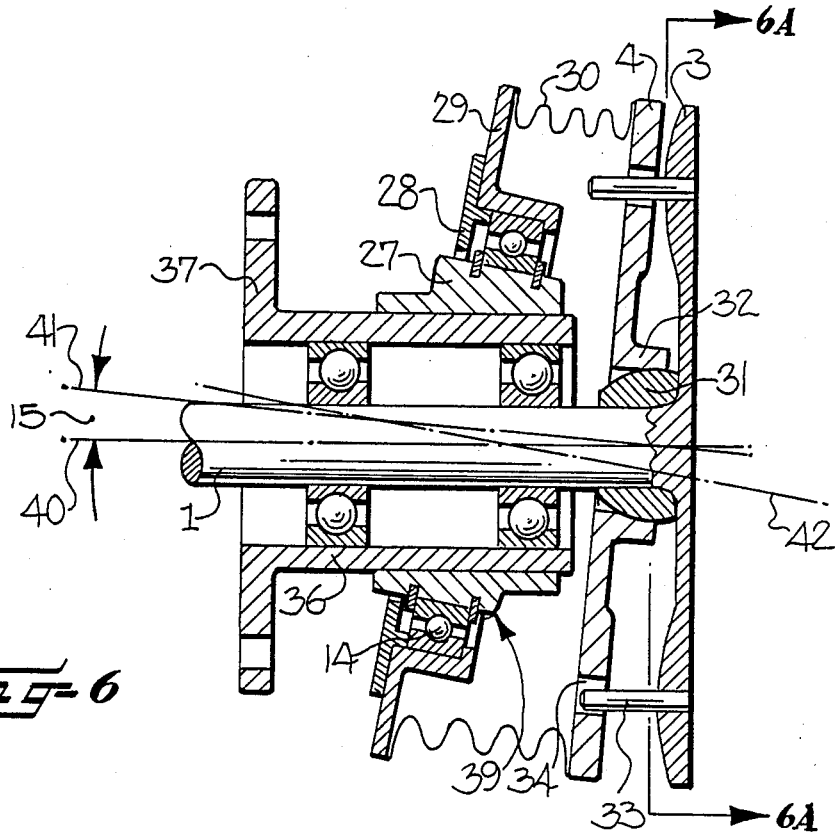
FIG. 6 is a side elevational view of still another embodiment of the present invention.

FIGS. 5A and 5B show further embodiments of the invention. In these embodiments, the disc 3 is integrally formed at the end of a slotted annular sleeve or hub 22, and the hub is rotatably mounted by means of a ball bearing 14. The disc 4 is mounted at the end of a drive shaft 1, but it will be understood that the disc 4 can otherwise be rotatably mounted in any conventional manner. The shaft 1 is mounted in the bearings 12, and a support member 36, 37, as seen in FIG. 6 may be provided for supporting the bearings 12, if desired. The bearing 14 and the hub 22 define a rotational axis for the disc 4, which is inclined with respect to and intersects the axis of the drive shaft by the angle 15 in the manner described above.

In FIG. 5A, the hub 22 and the disc 3 are slotted as indicated at 10, and these slots permit the hub 22 and disc 3 to be positioned through the slots (not shown) in the disc 4. The disc 3 is held from passing through the slots of the disc 4 due to the force of the compression spring 11, by an interengagement between the knobs 8 and 9. More particularly, the discs may initially be assembled as illustrated, and then, for example, the knobs 9 may be mounted on the disc 4 with the knobs 9 being sized in the circumferential direction so as to extend over the slots in the disc 3 in both directions, and so that the knobs 9 engage the knobs 8 on the disc 3.

The ball bearing 14 as seen in FIG. 5A engages a shoulder on the hub 22 and it is supported on the other side by a snap ring 26 which is positioned in a groove in the hub 22. A snap ring 25 serves as an abutment for the spring 11, which also engages the bearing 14.

The design of the disc 3 is modified in the embodiment of FIG. 5B, and in this embodiment, the disc 3 has a yarn engaging surface which is not interrupted by slots. Rather, only the annular hub 24 is slotted, and radially limited openings in the disc 4 are provided and through which the resulting fingers 24 of the hub 22 can be received. In addition, in this embodiment a reinforcing ring 23 is provided on the hub 22 in the region of the bearing 14, and as shown, the ring 23 surrounds the fingers in such a way that they fit in a groove provided for them, with the fingers being radially and circumferentially secured in the groove. The portion of the reinforcing ring 23 which is on the outside of the fingers 24 receives the snap ring 26 for the bearing 14. Since the slots between the fingers 24 are closed by the reinforcing ring 23, a rigid structure is produced so that only a few fingers 24 need to be distributed over the periphery, and such that the disc 4 is able to provide a yarn engaging surface which is interrupted at only a few points. The knobs 8 and 9 also can be distributed over the periphery of the discs 3 and 4 regardless of the arrangement of the fingers which extend through the openings in the disc 4.

Figure 6A:
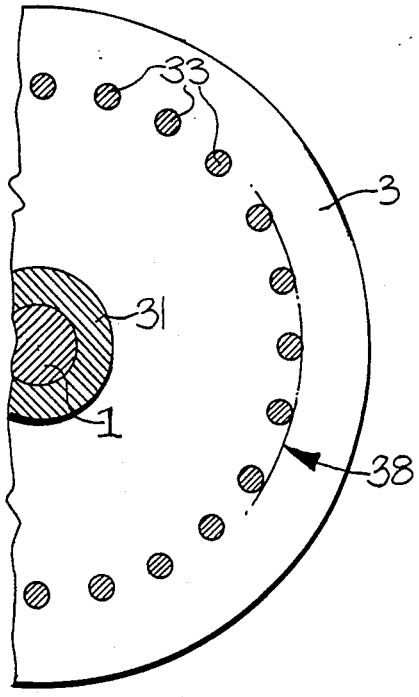
FIG. 6A is a fragmentary sectional view taken substantially along the line 6A—6A of FIG. 6.

FIGS. 6 and 6A show a further preferred embodiment of the present invention. In this embodiment, a plurality of pins 33 are mounted to the disc 3 and extend in an axial direction which is parallel to the axis of the drive shaft 1. The pins 33 are mounted on a pin circle 35 which is concentric to the axis of rotation of the disc 3, and the pins collectively form a yarn guide track 38 for radially supporting the advancing yarn. The pins 33 engage in holes 34 which are arranged over a corresponding circle of the disc 4, and thus the pins produce a positive rotational connection between the two discs 3 and 4. The holes 34 may be of circular cross section, in which case they must be oversized so as to allow a free relative radial movement of the ends of the pins 33 during the course of the rotation. However, such construction necessarily permits a limited relative movement in the circumferential direction, which can lead to undesirable torsional vibrations. To avoid such vibrations, the holes 34 may alternatively be designed as radially directed slots with semi-circular radial limits. The width of such slots then preferably corresponds to the diameter of the pins 33 and exceeds such diameter only by the small amount required for easy sliding of the pins into the slots. The length of the slots is calculated such that the relative radial movement of the pin ends in the slots may be accommodated without difficulty.

The inclined disc 4 of FIG. 6 and 6A is mounted by a gimbal bearing composed of a ball seat 31 and the hub 32 which includes a spherical support surface and which has substantially no relative movement with respect to the seat 31 in the circumferential direction. However, the disc 4 can readily follow any possible irregularities in the yarn. The engaging surface of the hub 32 may have a cylindrical form as opposed to the illustrated cylindrical form, so that it is freely movable on the ball seat 31 along its axis of rotation 41.

The ball bearings which rotatably support the drive shaft 1 as seen in FIG. 6 and 6A, are positioned in a support member 36 which is fixed, for example, on the machine frame by means of the flange 37. A slanting seat 27 is fixedly mounted on the support member 36, and the seat 27 has a cylindrical mounting surface 39, whose axis 42 intersects the axis 40 of the drive shaft and disc 3. The axis 42 also intersects the axis 41 of the disc 4, and the axes 40, 41, and 42 lie in a common plane. However, the axis 42 does not intersect the axes 40 and 41 at the same point, and a common point of intersection for the three axes can only be achieved in the special case where the pivoting angle of the axis 42 is equal to the angle 15 by which the axis 41 of the disc 4 is separated from the axis 40 of the driving shaft 1 and disc 3. The angle by which the axis 42 is pivoted is preferably greater than the angle 15, for the reasons explained below.

A ball bearing 14 is supported on the cylindrical surface 39 by snap rings. A spring abutment member 29 is mounted so as to be freely rotatable on the bearing 14, and the member 29 is secured in the axial direction by means of a cover plate 28 which also is fixed to the bearing 14 inside of the member 29. A bellows-like compression spring 30 is positioned between the abutment member 29 and the disc 4, and the spring 30 is fixed to the periphery of the abutment member 29 and to the periphery of the disc 4 in such a way that the abutment member 29 is set into rotation by the rotation of the disc 4 by reason of the interconnecting spring 30.

The angle by which the axis 42 of the mounting surface 39 is separated from the axis of rotation 40 of the drive shaft 1, is preferably greater than the angle 15, as is shown in FIG. 6. During rotation of the discs 3 and 4, relatively strong forces are applied to the disc 4 which attempt to turn it into a position perpendicular to the axis 40. This force can be overcome relatively well when the angle associated with the mounting surface 39 is greater than the angle 15, and for example assumes a value corresponding to at least about 1.2 to 2 times the angle 15, to thereby assure that the disc 4 assumes the desired inclined position.

The size of the angle 15 is also substantially dependent on speed, and in addition, the size of the angle 15 can also be determined by providing a cylindrical seat surface whose axis is substantially identical to the axis 41 of the disc 4, rather than the ball seat 31. However, the design of the mounting for the disc 4 according to FIG. 6, and with the ball seat 31 and ball surface 32, will lead to an inclined position of the disc 4 which is smaller than the inclined position defined by the axis of the surface 39, and such inclined position is insured for the disc 4. The ball seat 31 and surface 32 has the additional advantage that the inclined disc 4 can follow possible yarn irregularities, while providing a uniform pressing force, by reason of its free pivotability and the relatively small mass to be accelerated.

In the drawings and specification, there has been set forth a preferred embodiment of the invention, and although specific terms are employed, they are used in a generic and descriptive sense only and not for purposes of limitation.

That which I claim is:

1. A yarn conveying apparatus comprising a pair of yarn conveying discs, with each disc including a yarn engaging front surface, means mounting said discs for rotation about respective non parallel and intersecting axes and in respective rotational directions such that portions of the respective yarn engaging front surfaces are disposed in a closely adjacent opposing face-to-face relationship and define a yarn advancing zone therebetween, and such that the respective yarn engaging front surfaces run in substantially the same direction through said yarn advancing zone, means disposed adjacent the radial peripheries of said discs for rotatably interconnecting said discs, and including yarn guide surface means fixed to one of said discs and concentric to the axis of said one disc for supporting the yarn in a radially inward direction and at a fixed radial location as the yarn advances through said yarn advancing zone, and means resiliently biasing said discs toward each other at said yarn advancing zone, an so that upon rotation of said discs, the discs are adapted to engage and advance a yarn which is guided through said advancing zone without substantial slippage.

2. The yarn conveying apparatus as defined in claim 1 wherein each of said discs defines a rotational centerpoint, and wherein said axes of rotation of said discs intersect at a location which is substantially between said two centerpoints.

3. The yarn conveying apparatus as defined in claim 2 wherein said axes of rotation intersect at an angle of between about 2° and 15°.

4. The yarn conveying apparatus as defined in claim 1 wherein said yarn guide surface means comprises an annular hub fixed to one of said discs.

5. The yarn conveying apparatus as defined in claim 1 wherein each of said yarn engaging front surfaces comprises a hard, wear resistant material.

6. The yarn conveying apparatus as defined in claim 1 wherein each of said discs is composed of a metal, and said yarn engaging surfaces includes a ceramic coating.

7. The yarn conveying apparatus as defined in claim 1 wherein each of said discs is composed of a metal, and said yarn engaging front surfaces includes a coating of a resilient abrasion resistant material.

8. The yarn conveying apparatus as defined in claim 1 wherein said yarn engaging front surfaces are each provided with spaced apart knobs which mesh with each other at said yarn advancing zone.

9. A yarn conveying apparatus comprising first and second yarn conveying discs, with each disc including a yarn engaging front surface, and with said second disc including a plurality of radial fingers which are regularly spaced apart about the periphery thereof, means rotatably mounting said first disc for rotation about a first axis, and including an annular hub mounted coaxially about said first axis, with said first disc being coaxially and fixedly mounted to said hub, and with said hub including a plurality of axial slots which are regularly spaced apart about the periphery thereof, means rotatably mounted said second disc for rotation about a second axis which is non-parallel to and intersects said first axis at a location within said hub, and with said fingers of said second disc meshing in respective ones of said slots in said hub so that said first and second discs rotate in unison, and such that portions of the respective yarn engaging front surfaces are disposed in a closely adjacent opposing face-to-face relationship and define a yarn advancing zone therebetween, and such that the respective yarn engaging front surfaces run in substantially the same direction through said yarn advancing zone, and means resiliently biasing said discs toward each other at said yarn advancing zone, and so that upon rotation of said discs, the discs are adapted to engage and advance a yarn which is guided through said advancing zone without substantial slippage.

10. The yarn conveying apparatus as defined in claim 9 wherein said means mounting said second disc includes a radially open annular groove formed in the periphery thereof, and a fixed follower extending radially into said groove.

11. The yarn conveying apparatus as defined in claim 10 wherein said biasing means comprises spring means positioned between said hub and said second disc.

12. The yarn conveying apparatus as defined in claim 9 wherein said means mounting said second disc comprises a shaft coaxially and fixedly mounted to said second disc, and means rotatably mounting said shaft for rotation about said second axis.

13. The yarn conveying apparatus as defined in claim 1 wherein said means for rotatably interconnecting said discs comprises an annular hub mounted coaxially to said first disc, with said hub including a plurality of axial slots which are spaced about the periphery thereof, a plurality of radial fingers mounted to said second disc and which are spaced about the periphery thereof, with said fingers meshing in respective ones of said slots in said hub, and with the outer periphery of said hub forming said yarn guide surface means.

14. The yarn conveying apparatus as defined in claim 1 wherein said means mounting said discs includes a mounting shaft fixedly supporting said first disc, and gimbal means supporting said second disc upon said shaft.

15. The yarn conveying apparatus as defined in claim 14 wherein said means for rotatably interconnecting said discs comprises a plurality of axial pins mounted to a first of said discs in a regularly spaced apart circular arrangement which is coaxial with respect to the rotational axis of such first disc, and a plurality of aperture in the other of said discs and which are arranged to receive respective ones of said pins, and such that the outer peripheries of said pins form said yarn guide surface means.

* * * * *